United States Patent [19]

Boots

[11] 4,019,635

[45] Apr. 26, 1977

[54] PALLET-CONTAINER FOR TRANSPORTING BULK MATERIAL

[75] Inventor: Gerardus Anthonius Maria Boots, Zaandam, Netherlands

[73] Assignee: Akzo N.V., Arnhem, Netherlands

[22] Filed: Nov. 14, 1975

[21] Appl. No.: 631,914

[30] Foreign Application Priority Data

Nov. 14, 1974 Netherlands ..... 7414833
Apr. 29, 1975 Netherlands ..... 7505061

[52] U.S. Cl. ..... 206/386; 108/55.1; 217/43 A; 229/14 BE; 229/23 A

[51] Int. Cl.[2] ..... B65D 19/00

[58] Field of Search ..... 229/9, 14 BA, 14 BE, 229/14 BW, 19, 23 A, 23 C; 206/386; 217/43 A; 108/55 R, 55 A, 55.1

[56] References Cited

UNITED STATES PATENTS

| | | | |
|---|---|---|---|
| 2,003,326 | 6/1935 | Wellman | 229/23 A |
| 2,077,173 | 4/1937 | Holy | 229/23 A |
| 2,077,174 | 4/1937 | Hyndman | 229/23 A |
| 2,296,895 | 9/1942 | Bergstein | 229/14 BW |
| 2,556,321 | 6/1951 | Denton | 229/14 BW |
| 2,633,982 | 4/1953 | Addison | 108/55 A |
| 2,762,551 | 9/1956 | Fallert | 108/55 R |
| 2,925,210 | 2/1960 | Fallert | 229/23 A |
| 3,261,532 | 7/1966 | Davis | 206/386 |
| 3,291,364 | 12/1966 | Fischer | 206/386 |
| 3,348,738 | 10/1967 | Hertlein | 108/55 R |
| 3,424,364 | 1/1969 | Grafslund | 206/386 |
| 3,443,737 | 5/1969 | Kupersmit | 229/23 R |
| 3,494,535 | 2/1970 | Acker | 108/55 R |
| 3,797,727 | 3/1974 | Downing et al. | 229/23 A |

*Primary Examiner*—George E. Lowrance
*Assistant Examiner*—Bruce H. Bernstein
*Attorney, Agent, or Firm*—Stevens, Davis, Miller & Mosher

[57] ABSTRACT

A container for transporting bulk material either solid or liquid has a pallet and a sleeve having segments of its wall secured to the pallet and other segments of its wall folded inwardly to provide flaps. A tubular member having corrugated-paperboard or the like wall and a cross-section corresponding to that of the sleeve has one end thereof disposed in the sleeve and resting on the flaps. A plastic bag may be inserted in the container and is folded about its edges to overlap the flaps. A rigid disk such as a corrugated paperboard disk having a cross-section substantially equal to the cross-section of the sleeve is disposed in the bag adjacent its closed end with its peripheral edge under the flaps. When the bag is filled with material, it is expanded against the wall of the tubular member and the tubular member is pressed against the sleeve thereby securing the tubular member in the sleeve. A cup-shaped lid is slidably disposed over the open end of the tubular member to enclose the bag.

3 Claims, 1 Drawing Figure

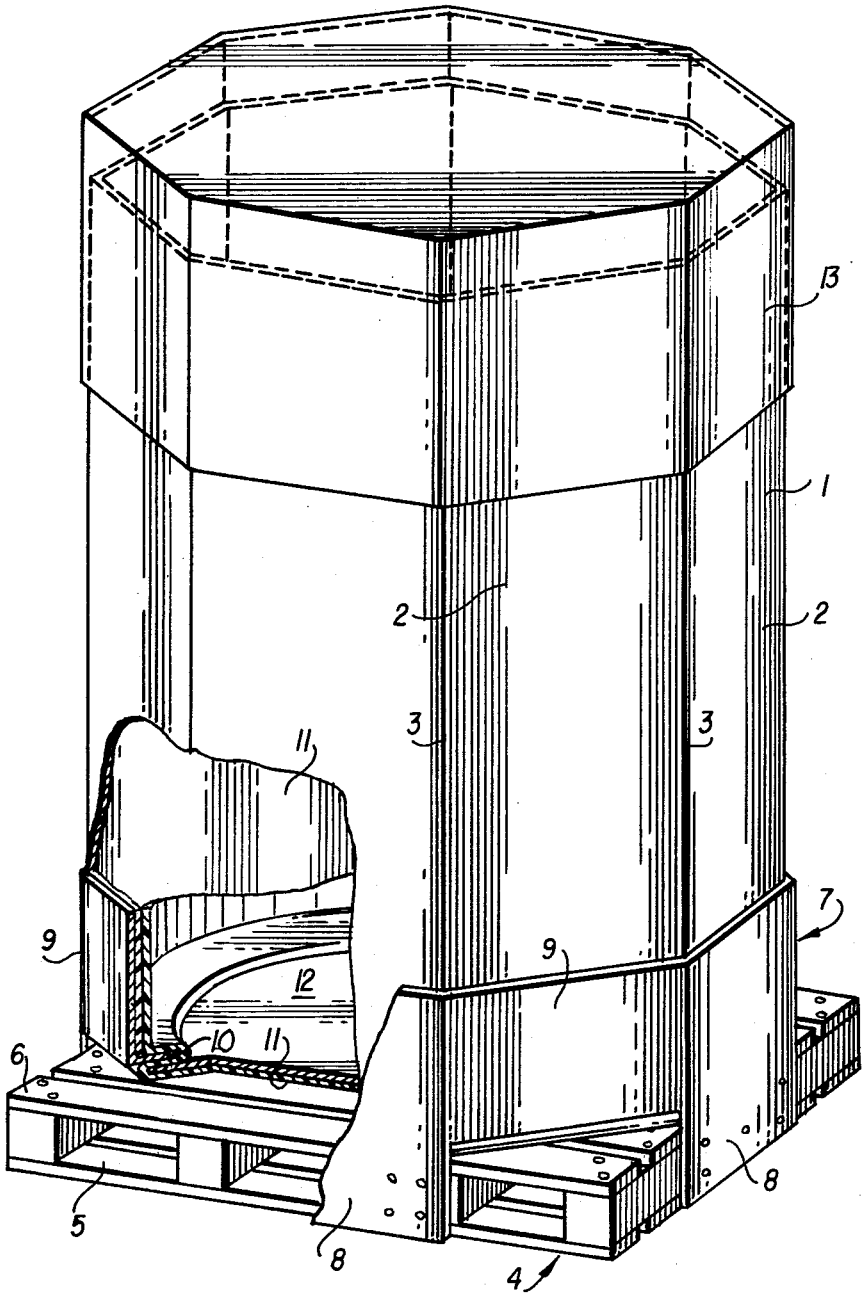
13
1
2
2
3
3
11
7
9
9
12
10
11
6
5
8
8
4

PALLET-CONTAINER FOR TRANSPORTING BULK MATERIAL

This invention relates generally to a container for transporting bulk material and more particularly to a container having a tubular cardboard or corrugated board container supported on a pallet.

Pallet-containers of the type indicated above are known. One known embodiment is formed by gluing an octagonal bottom piece of corrugated board to the top of a pallet. This bottom piece is provided with flaps which are bent into the form of raised edges and together form a sleeve into which there may be fitted a tubular body made of corrugated board and having an octagonal cross-section. The sleeve and the tubular body are then attached to each other by means of, for instance, staples. On the upper end of the tubular body there may be fitted a cap. It is often found that the combination of the tubular body, the pallet, and the bottom piece is incapable of withstanding the forces exerted on it during transportation and that the glue between the bottom piece and the pallet does not hold and/or the tubular body and the sleeve are disconnected. The tube may then tumble off the pallet. The use of the above type of pallet-containers has the further disadvantage that for the stocking and the assembling of the combinations of the pallet, the tube, the lid and very often also the bag a lot of storage space is taken up at the place where the containers are filled, due to the long setting time of the glue and the complicated construction. Besides, the assembling of the combinations requires much manpower. Furthermore, it is often found that these pallet-containers can be used only once, it being practically impossible to disassemble the glued and stapled components without damaging them.

An object of the invention is to provide a container supported on a pallet which is devoid of the foregoing disadvantages. Another object of the invention is to provide an improved pallet-container for bulk material, either solid or liquid.

Other objects will become apparent from the following description with reference to the only figure of the drawing which is a perspective view, partially in section, of one embodiment of the invention.

The foregoing objects are accomplished in accordance with the invention, generally speaking, by providing a container having a tubular body, preferably polygonal in cross-section, and an open end, an opposite end secured to a pallet or platform and a cup-shaped lid member slidably disposed over the open end. More specifically, the invention provides a container for liquid or solid material or the like having a tubular body, which may be formed from sheet material such as, for example, corrugated paperboard, having an open end and an opposite end secured to a pallet. The pallet may be formed from two spaced layers of wood slats secured to opposite sides of cross-members which extend between the two layers of slats. A sleeve having a cross-section like that of the tubular body has panels which are fastened to the sides of pallet and other panels which are bent inwardly to form flaps over the top surface of the pallet. The open end of the tubular body fits snugly within the sleeve with its edge resting on the inwardly folded flaps. A plastic bag such as one formed from polyethylene or polyvinyl chloride film may be used as a liner for the container. A paper disk having a diameter approximating the internal diameter of the tubular body of the container is disposed in the bag across the closed end thereof and the bag is disposed in the container with the peripheral edge of its closed end extending over and underneath the flaps of the sleeve and with the edge of the disk disposed between the flaps and the surface of the pallet.

In a preferred embodiment of the invention, two or more panels of the sleeve have downward extensions which partly cover the adjacent sides of the pallet and which are attached to the pallet and the tube and the sleeve are so dimensioned that the tube is slidably mounted in the sleeve, and the height of the sleeve above the pallet is in the range of 20 – 65 cm.

In the pallet-container according to the invention, the tube is secured to the pallet as a result of some clamping pressure being exerted between the tube panels and the sleeve panels, the sleeve being firmly connected to the pallet by the panel extensions. The clamping force is rather small as long as the container is in the unloaded state, but it increases considerably as the container is filled with bulk material, under the influence of the lateral force applied to the panels of the tube by the contents. Because of this force the panels of the tube will somewhat bulge outwardly, as a result of which they are pressed against the sleeve. The resulting connection between the tube and the pallet is very tight and yet flexible because it still allows a certain amount of movement of the tube within the sleeve when the pallet-container is exposed to sudden great loads, which occasionally occur during the transportation of pallet-containers by trucks, forklift trucks, railroad wagons, cranes etc.

The relative movement of the tube within the sleeve, in spite of the clamping force exerted between these parts, provides for the absorption of a large proportion of the impact energy. This yielding under sudden heavy loads prevents ruptures in the component parts and also in the fixed connections of the pallet-container combination.

The connection obtained between the tube and the sleeve is sufficiently strong to prevent the tube containing the material from sliding out of the sleeve and yet is flexible enough to prevent ruptures leading to the tube with its contents tumbling off the pallet.

The clamping force between the tube and the sleeve generally increases with the height of the sleeve. However, it is found that a height of the sleeve in the range of 20 – 65 cm provides a sufficiently great clamping force and yet allows of relative movements of the tube within the sleeve in case of loads of a magnitude that could be detrimental to the component parts and the connections.

The pallet-container according to the invention can be composed using very little manpower, in a simple manner and very rapidly by successively placing the sleeve on the pallet and sliding the tube into it from above. If a bag is used, it may be placed on the pallet beforehand.

The assembling may be done just before use and at a spot near the place where the containers are filled. The combination is ready for use immediately after it has been assembled. The tubes used for the body of the container may be made available in the form of stacked blanks which need only be unfolded because at their lower end they have no edges that are to be folded back. The sleeves of corrugated board also are provided in the form of blanks. After disassembly, all parts, if undamaged, are suitable to be used again because the tube is not secured to the pallet by means of staples or by gluing but exclusively by the tube exerting some clamping pressure on the sleeve. In itself it is surprising that merely the use of clamping forces makes it possible for the pallet and the tube to form a particularly rigid assembly.

Commonly used pallet-containers have a tube height in the range of 150 – 200 cm. For pallet-containers having such a tube height it is found that the height of the sleeve of pallet-containers according to the invention should not be more than one-third of said tube height, and preferably be within the range of 30 – 50 cm. It is preferred that the sleeve as well as the tube should be made of corrugated board.

However, they also may be made of some other suitable sheet material, which may be of plastics, wood, metal or combinations thereof with, for instance, textile sheet material, if desired. The sleeve should have such dimensional stability that the panels of the tube as they expand as a result of the pressure exerted by the contents will be clamped against the sleeve, so that the tube and the pallet are secured to one another. The clamping of the tube on the sleeve of corrugated board may be increased by giving the sleeve higher dimensional stability with the aid of folded flaps. In the case of a pallet-container with octagonal cross-section this may be realized in a simple manner in that the lower ends of the sleeve panels positioned between the panels attached to the pallet sides are folded inwardly and form flaps which rest on the pallet.

By attaching the downward sleeve extensions to the pallet the connection of the sleeve to the pallet is found to be very reliable. Preferably the downward extensions have the same width as the panel. The extensions may be attached to the sides of the pallet by means of staples or glue or by other connecting means. The extensions also may be made larger so that they can be folded around the bottom edge of the pallet and attached to the under side of the pallet by suitable connecting means.

The cross-section of the tube may be square, hexagonal, octagonal or polygonal and may be of regular or irregular shape.

To promote rapid assembly of the combination of pallet and container it is desirable that there should be some slight play between the outside of the tube and the inside of the sleeve. This play is preferably of the order of magnitude of the thickness of the board.

The board thickness of the sleeve may be chosen equal to that of the tube or may be chosen different from that, depending on the condition under which the container is to be used.

If a bag is employed, it may be protected by placing a cardboard base inside the tube on the pallet. To facilitate the filling of the bag a piece of board also may be placed inside the bag.

Containers of this type can in a known way be discharged at their bottom via a central opening in the pallet. When use is made of a bag, its bottom is at the spot where the containers are discharged cut open through an opening in the pallet and the bulk material will flow out of the bag.

It has been found, however, that in that case part of the contents will be left in the folds of the bag and on the bottom thereof. Additional work is to be done then to remove as yet the remainder of the contents via the discharge opening. Besides, the outflowing bulk material, particularly if it is a liquid, may come into contact with the hands of attending people immediately after the bag has been cut open.

It is therefore of advantage not to discharge these containers at the bottom but at the top, which may be done by tilting the containers with the aid of some appropriate apparatus. What happens then, however, is that during discharging the bag will contract to form a narrow trunk so that it is not properly emptied. This drawback may be obviated by so positioning the bag that at its bottom periphery the bag is clamped between the pallet and the inwardly folded sleeve flaps. As a result, the bag while it is tiltingly discharged will very much stay in contact with the inside of the tube, so that there will not remain any material in the folds of the bag. Moreover, the discharging may then very well be carried out in stages.

Another advantage is that owing so that weight of its contents the bag is very tightly clamped between the underside of the turned in parts of the sleeve and the pallet so that the arrangement will have great rigidity. The filled bag moving in the tube during transport, as a result of which the container may be subjected to heavy shocks and the pallet to an oblique load, will be prevented entirely in this way.

The bag may be effectively clamped if inside the bag and on the bottom thereof there is provided a plate or ring which extends to underneath the turned in flaps of the sleeve. The plate or ring may be of corrugated fiberboard or some other board or it may be of some plastics material. The external dimension of the plate or ring is, of course, somewhat smaller than the internal dimension of the tube. The plate or ring and the tube may be correspondingly shaped. It has been found that a different shape, for instance a round one, is also satisfactory, provided that the plate sufficiently extends to underneath the turned in parts of the sleeve.

The plate or ring facilitates inserting the bag, which during filling will come to lie against the inside of the tube evenly and without too many folds.

With the plate or ring the bag is moreover very reliably secured to the bottom, which continues to be the case even when the container is tipped, or the container is unloaded by means of an aspirator, in which case the bag is prevented from being sucked into the aspirator inlet opening.

Another method of evenly positioning the bag in the container and properly spreading the bag parts to be clamped consists in providing the bottom of the bag with extensions which are attached to the pallet, for instance by nailing.

The above-described containers may, of course, be so constructed that they can be discharged at their bottom.

The bag may have a normal shape or be in the form of a tube which is tied up at the bottom.

After having been filled, either type of bag can be tied up at the top.

The invention will be further described with reference to the accompanying drawing.

In the FIGURE, the numeral 1 refers to a tube of corrugated fiberboard having a regular, octagonal cross-section. The upright rectangular panels 2 of the tube 1 join at the ribs 3 which are formed by the folds in the corrugated board. The tube is placed on the pallet 4.

The pallet 4 comprises a base board 5 and an upper board 6, both made up of slats. The pallet indicated here is of a conventional construction. It will be clear that pallets of diferent construction also may be used.

The tube 1 is located inside the sleeve 7 which is made of corrugated fiberboard.

The sleeve 7 fits over the tube 1. The sleeve 7 comprises the panels 8, which are attached to the four upright sides of the pallet by nails or staples.

The panels 8 alternate with panels 9 whose lower ends are folded inwardly to form flaps 10.

In the tube 1 is the plastics bag 11 which is to contain the material to be transported. The bag is formed by tubular film material which is tied up at the bottom. The bag also may be provided with a sewn-in and/or seam-welded bottom. In the bag and on the bottom thereof there is placed a piece of board 12 having a circular cross-section.

The turn-in flaps 10 of the panels 9 rest on the outwardly extended parts of the bag 11, the periphery of the piece of board 12 extending to between the flaps 10 and the outwardly extended parts of the bag. The container is closed by the cardboard cap or lid 13 which fits over the tube 1.

The lid 13 has a relatively high edge, so that it is slidable on the tube 1 over a large distance. If after the bag has been filled the material in it continues to settle, the lid will readily follow the subsiding material as long as the latter still projects above the tube.

This is of importance in the case of stacked pallet-containers, the bulk material in the containers below helping to support the load of the pallet-containers positioned above them.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. A container comprising a pallet having a top and sides, a first wall member enclosing an elongated space having a polygonal cross-section, the lower ends of at least two segments of the said wall member extending downwardly along the sides of the pallet and secured thereto and the lower ends of at least two segments of the wall member being folded to form inwardly extending flaps disposed against the top of the pallet, a second wall member open at both ends and having a cross-section similar to that of the first wall member, one end of the second wall member being slidably disposed in the first member with its edge disposed on the said flaps and extending above the first member, said second wall member being adapted to expand under the weight of material contained therein and pressed into engagement with the first wall member, whereby the two said members are secured together solely by said expansion of the second member.

2. The container of claim 1 comprising a flexible bag having a closed end adjacent to the pallet and a plate in the bag having a cross-section approximating that of the second wall member, said bag being disposed over and underneath the flaps, and said plate having its peripheral edge between the flaps and the pallet.

3. The container of claim 1 comprising a flexible bag in said second wall member, said bag having a closed end adjacent the top of the pallet, a plate in the bag, said being disposed over and underneath the flaps and over and underneath the periphery of the plate, and said plate has its periphery between the flaps and the top of the pallet.

* * * * *